United States Patent [19]

Barkemeyer

[11] 4,434,738

[45] Mar. 6, 1984

[54] RUDDER FOR WATERCRAFT

[75] Inventor: Wolfgang K. W. Barkemeyer, Reinbek, Fed. Rep. of Germany

[73] Assignee: Jastram-Werke GmbH & Co. KG, Fed. Rep. of Germany

[21] Appl. No.: 338,924

[22] Filed: Jan. 12, 1982

[30] Foreign Application Priority Data

Jan. 15, 1981 [DE] Fed. Rep. of Germany ..... 3101042
Nov. 20, 1981 [DE] Fed. Rep. of Germany ... 8133822[U]

[51] Int. Cl.[3] ..... B63H 25/06
[52] U.S. Cl. ..... 114/162
[58] Field of Search ..... 114/144R, 162, 163, 114/164, 165, 166, 167, 172; 244/87

[56] References Cited

U.S. PATENT DOCUMENTS 1,540,079 6/1925 Luchsinger ..... 114/167
2,246,203 6/1941 De Florez ..... 244/87
4,342,275 8/1982 Brix ..... 114/162

FOREIGN PATENT DOCUMENTS 228539 1/1969 U.S.S.R. ..... 114/162

*Primary Examiner*—Trygve M. Blix
*Assistant Examiner*—Jesus D. Sotelo
*Attorney, Agent, or Firm*—Beveridge, DeGrandi & Kline

[57] ABSTRACT

The fin of a fin rudder can, as desired, be locked to the rudder (single-area rudder), to the ship (forced control of fin through movement of main rudder), or separately pivotable (independent fin movement), the locking or actuating device being positioned within the hull (FIG. 1).

5 Claims, 4 Drawing Figures

RUDDER FOR WATERCRAFT

BACKGROUND OF THE INVENTION

The invention relates to a rudder for watercraft having a fin which can be rigidly locked to the main rudder, and an adjusting system for the fin which is disposed in the rudder engine space.

Rudders are disposed in the form of rotatable plates or displacement members on the stern of watercraft and when operated—i.e. when adjusted to a given rudder angle—produce a hydrodynamic transverse force which engages with the rudder and consequently with the end of the vessel, providing the steering force required to steer the vessel. The hydrodynamic transverse force produced by the rudder results in a rudder torque in relation to the pivoting axis of the rudder.

To produce high rudder transverse forces, two-part or multi-part rudders are known for use on vessels which require a high torque effect that occurs with rudders that are divided into several parts, particularly when the rear part of the rudder is adjusted in relation to the direction of the current more sharply than the front part of the rudder. Such constructions are known as high-performance rudders. In the case of multi-part high performance rudders of known construction the torque to be produced by the rudder engine is appreciably greater than in the case of a single-part displacement rudder of equal lateral area.

The known multi-part high performance rudders such as, for example, the BECKER-rudder, cannot be switched off. They make their high torque properties available not only when they are needed, namely for maneuvering at low speeds, but also at full operating speed. Due to the very high forces which are exerted on such a high performance rudder at relatively high speeds of the vessel, correspondingly strong connecting assemblies are required, namely the rudder stem, the rudder engine and the whole maritime connecting constructions at the stern.

It is therefore an object of the invention to provide a rudder having a fin for watercraft in which although, as in the prior art constructions fin adjustment can be constrainedly controlled by the movement of the main rudder, such constrained control can nevertheless be switched off; this is convenient more particularly at higher vessel speeds, to obviate the reinforced connecting assemblies otherwise needed. If required, the rudder can be converted into a single-part rudder.

A further condition for the rudder according to the invention is that all the elements which can be activated are easily accessible in the hull and not, as in certain prior art constructions, in the rudder blade, where they are constantly subjected to heavy loading due to vibration, icing, possible leaks and the like, and where they can neither be given maintenance nor repaired from the vessel if anything goes wrong.

SUMMARY OF THE INVENTION

To solve this problem the invention provides a rudder for watercraft which is so constructed that the main rudder stem takes the form of a hollow shaft in which a torsion rod is mounted which terminates at the base in the body of the main rudder, where it is connected to a fin-adjusting system.

At the top, the torsion rod extends beyond the yoke of the main rudder stem, where it has a changeover device for the locking system which can be brought into engagement optionally with a blocking member rigidly connected to the vessel or with a blocking member rigidly connected to the yoke. The changeover device for locking the fin optionally rigidly to the vessel or rigidly to the rudder can also comprise a drive unit which can be optionally activated or blocked.

The result is the following advantageous possibilities:

(a) if the torsion rod is rigidly locked to the vessel's hull, the result is that the lever mechanism according to the invention produces a fin movement which is forced by the movement of the main rudder.

(b) if the torsion rod is rigidly locked to the main rudder stem, the fin always maintains the same position in relation to the main rudder. If in this way the fin is locked in a position aligned with the main rudder, the effect transforms the rudder into a single-area rudder.

(c) if use is made of a blocking unit which can be activated optionally, the result is also that the fin can be moved on its own, without the main rudder engine being operated. For instance, to increase stability of course when the ship is at cruising speed, the main rudder can remain aligned in the longitudinal direction of the vessel. The very minor corrections required for holding course can be sensitively performed only by the fin. Specialists in the matter expect from this amongst other things considerable savings of fuel, since when a course is steered in the conventional manner using the whole main rudder, a measurable proportion of the propeller thrust is consumed by the adjusted rudder.

BRIEF DESCRIPTION OF THE DRAWINGS

The drawings show embodiments of the invention.

DETAILED DESCRIPTION OF A PREFERRED EMBODIMENT

Figure 1:
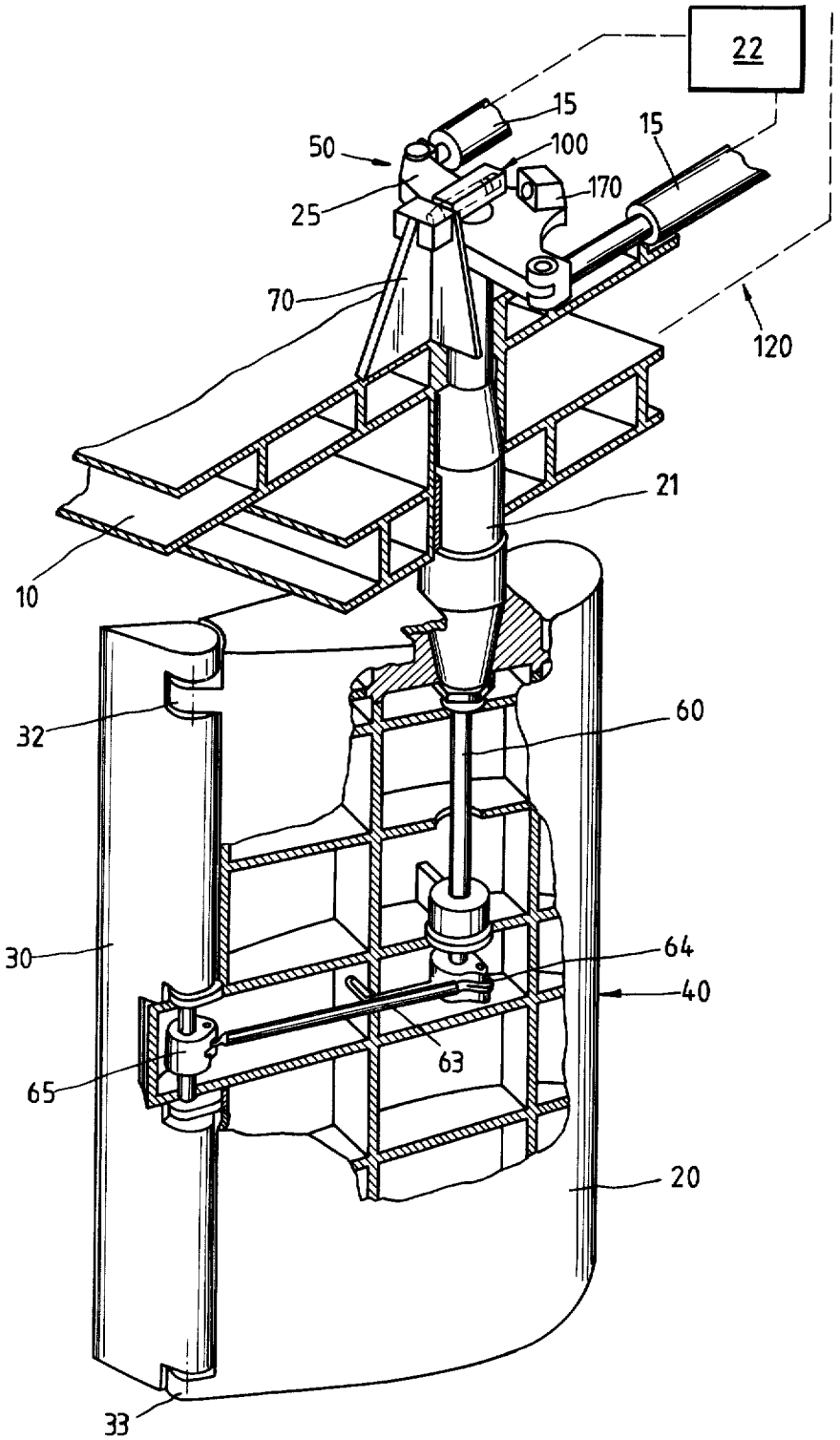
FIG. 1 shows diagramatically, partly in section, a main rudder with a fin and the adjustment and drive system.
Figure 2:
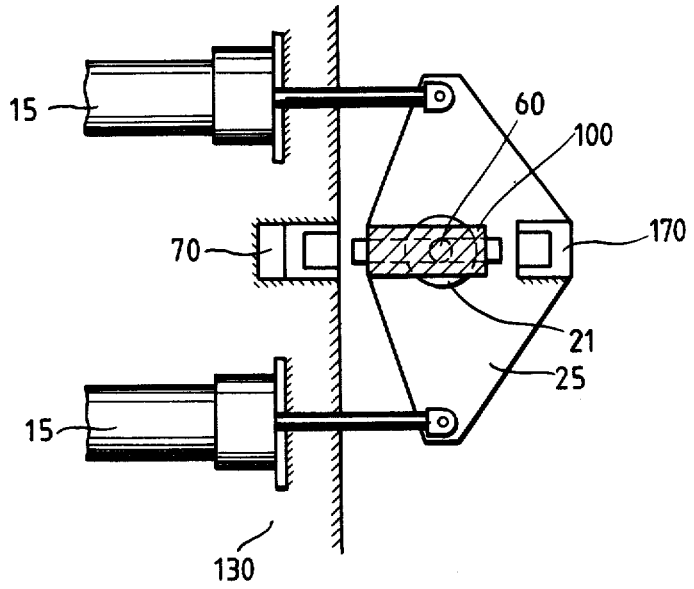
FIG. 2 is a plan view of the drive and locking system shown in FIG. 1.

FIG. 1 shows a ship's hull 10 and a main rudder 20 which can be pivoted by cylinders 15 of a rudder engine 22 via a rudder stem 21 and a yoke (rudder quadrant) 25. The main rudder 20 bears a fin 30 which is connected to the main rudder 20 at places 32 and 33. Both the main rudder 20 and the fin 30 can be pivoted around vertical axes. A locking system 50 is disposed in the rudder engine space 120. The rudder stem is constructed in the form of a hollow shaft in which torsion rod 60 is mounted which terminates at the base in the main rudder 20 and extends at the top beyond the end of the yoke 25. As shown also in FIG. 2, disposed at the top end of the torsion rod 60 is a changeover unit 100 which is operatively connected to a locking device (cf. FIG. 1) which comprises a blocking member 70 mounted rigidly to the vessel and a blocking member 170 mounted rigidly to the yoke, so that the changeover unit 100 can be used optionally for locking in relation to the blocking member 70 mounted rigidly to the vessel or in relation to the blocking member 170 mounted rigidly in relation to the yoke. The changeover unit 100 can be electrically, hydraulically, pneumatically or mechanically remote-controlled; it can also be activated directly manually.

The main rudder 20 has a system 40 for the adjustment of the fin 30. The adjusting system 40 consists of a first eccentric 64 which is disposed at the bottom end of the torsion rod 60 and via a push-and-pull control rod 63 adjusts a second eccentric 65 whose shaft is rigidly connected to the pivot of the fin 30.

If the changeover unit 100 performs locking to the blocking member 170, the torsion rod 60 is not rotated in relation to the rudder stem. The fin 30 remains parallel with the main rudder 20 in all adjustment angles thereof. If in contrast the changeover unit 100 performs locking with the blocking member 70, the rudder stem is rotated in relation to the torsion rod 60 with changes in the position of the rudder. In this way, via the adjusting system 40 the fin 30 is adjusted towards the direction of the current more strongly than is the main rudder 20. The angle of adjustment of the fin 30 in relation to the main rudder 20 depends on the geometry of the adjusting system 40 and can be given thereby for a required constrained control.

In the case of constant blade angle of the rudder at high speeds, the torsion rod 60 itself rotates. The fin 30 is not adjusted as strongly as at low speeds, so that the fin 30 and connecting parts are not so heavily loaded. More particularly, impact loadings caused, for instance, by ice floes, are resiliently absorbed.

Figure 3:
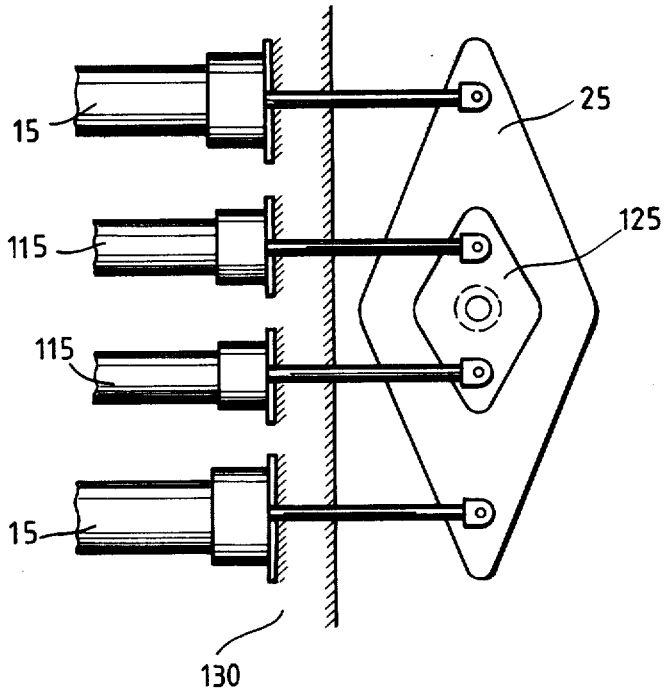
FIG. 3 is a plan view of the drive and locking system shown in FIG. 4.
Figure 4:
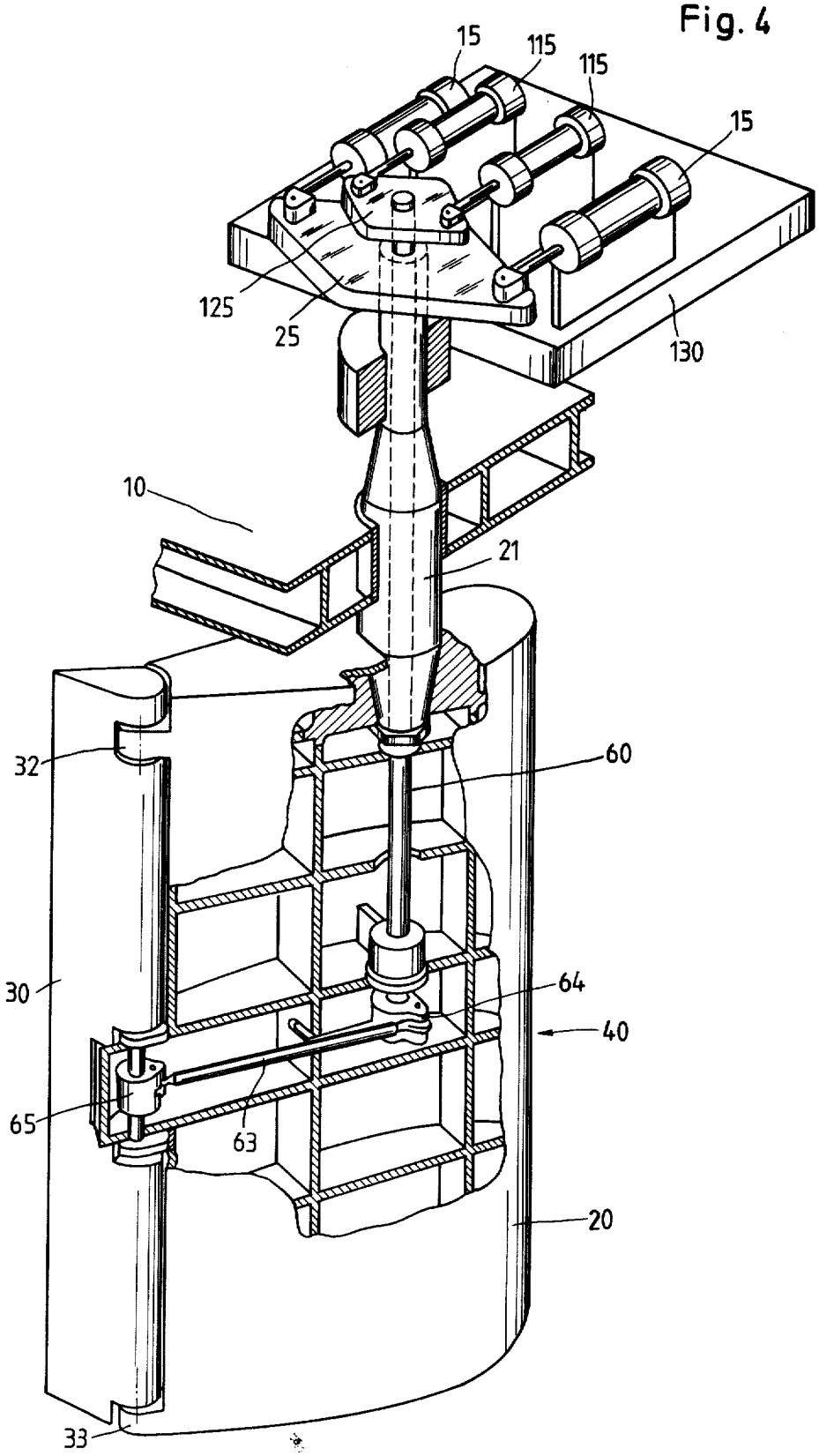
FIG. 4 is a diagramatic view, partly in vertical section of a main rudder with a fin and a locking system which can be optionally activated or blocked.

Another advantageous embodiment is illustrated in FIG. 4 in which, similarly to the main rudder stem 21, the torsion rod 60 bears a yoke (cf. also FIG. 3) which can be optionally moved in relation to a foundation rigidly connected to the ship or rigidly blocked together therewith via drive units 115 which can be activated or blocked and which are shown in the drawings as hydraulic cylinders, by way of example. Instead of the hydraulic drive units illustrated, any other suitable electric, pneumatic or even mechanical drive unit is suitable, so long as it can be blocked. If now the drive elements 115 are blocked the rudder stem 21 is rotated in relation to the torsion rod 60 when the rudder changes position.

If the drive unit of the fin is moved synchronously with the main rudder engine, the torsion rod 60 does not move in the rudder stem. The fin and main rudder are in practice blocked to one another.

The third possible combination is that the main rudder can be retained fast amidships by the main rudder engine 15, the ship being steered exclusively by the fin, via the fin-actuating unit 115.

The advantages of this manner of operation have already been set forth hereinbefoe under point (c).

What is claimed is:

1. A rudder for a watercraft comprising a main rudder member; a hollow rudder shaft adapted to attach said main rudder member to a watercraft for pivotal movement of said main rudder member about a vertical axis with respect to the watercraft; a fin member; means for attaching said fin member to said main rudder member for pivotal movement of said fin member about a vertical axis with respect to said main rudder member; a pivotal yoke member attached to said hollow rudder shaft; means for pivoting said yoke member with respect to the watercraft; a torsion bar passing through said hollow rudder shaft and having a first end and a second end; means coupling said torsion bar first end to said fin member for pivoting of said fin member in response to twisting of said torsion bar; means coupled to said torsion bar second end for twisting said torsion bar; a first blocking member adapted for attachment to the watercraft; a second blocking member attached to said yoke member; and a locking member movable between a first locking position, in which said torsion bar is locked to said first blocking member permitting pivoting of said fin member with respect to said main rudder member, and a second locking position, in which said torsion bar is locked to said second blocking member preventing pivoting of said fin member with respect to said main rudder member.

2. A rudder as claimed in claim 1 in which said locking member is further movable to a third locking position in which said torsion bar is independent of both said first blocking member and said second blocking member.

3. A rudder as claimed in claim 1 in which said means coupling said torsion bar first end to said fin member comprises a first eccentric member attached to said torsion bar; a second eccentric member attached to said fin member; and a control bar coupling said first eccentric member to said second eccentric member.

4. A rudder as claimed in claim 3 in which said first and second eccentric members and said control bar are within said main rudder member.

5. A rudder as claimed in claim 1 in which said locking member includes hydraulic means for moving said locking member between the first locking position and the second locking position.

* * * * *